United States Patent [19]

Fienhold et al.

[11] 4,190,207

[45] Feb. 26, 1980

[54] PULSATING SPRAY APPARATUS

[75] Inventors: Stephen C. Fienhold; Michael A. Cammack, both of Ft. Collins, Colo.

[73] Assignee: Teledyne Industries, Inc., Ft. Collins, Colo.

[21] Appl. No.: 913,284

[22] Filed: Jun. 7, 1978

[51] Int. Cl.[2] ..... B05B 1/08; B05B 1/18

[52] U.S. Cl. ..... 239/381; 138/46; 239/447; 239/449; 239/570

[58] Field of Search ..... 239/101, 102, 380–383, 239/389, 436, 443, 444, 446–449, 533.1, 570; 138/44–46

[56] References Cited

U.S. PATENT DOCUMENTS 3,958,756 5/1976 Trenary et al. ..... 239/383 X 3,999,714 12/1976 Lang ..... 239/570

*Primary Examiner*—Andres Kashnikow

*Attorney, Agent, or Firm*—Hugh H. Drake

[57] ABSTRACT

A pulsating spray nozzle has a number of features including the introduction into the outer periphery of a forced vortex of a speed-control fluid. In such a forced-vortex environment, a floating turbine is enabled by means of paths correlated with outlet openings better to avoid stalling. Improved dimensioning of elements in the forced-vortex-turbine approach also contributes in that direction. A regulator limits the rate of flow of fluid through the device to a predetermined maximum amount upon increase of incoming water pressure beyond a selectable level.

16 Claims, 26 Drawing Figures

Fig.-6
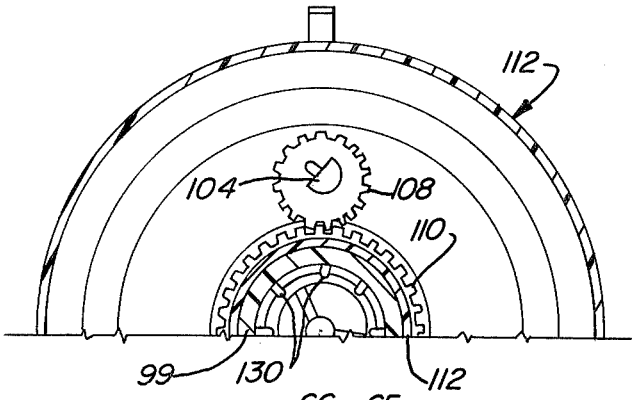
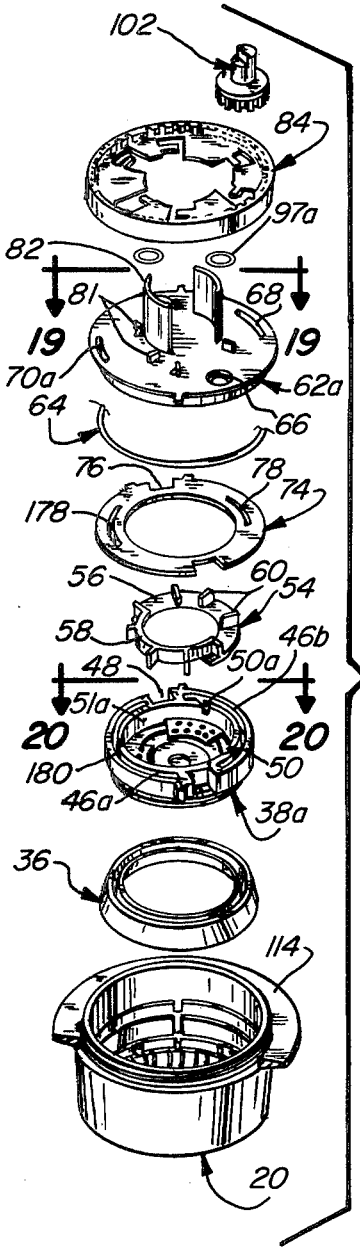
Fig.-18
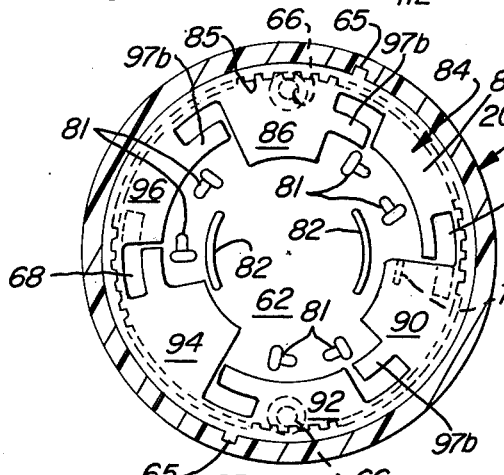
Fig.-5a
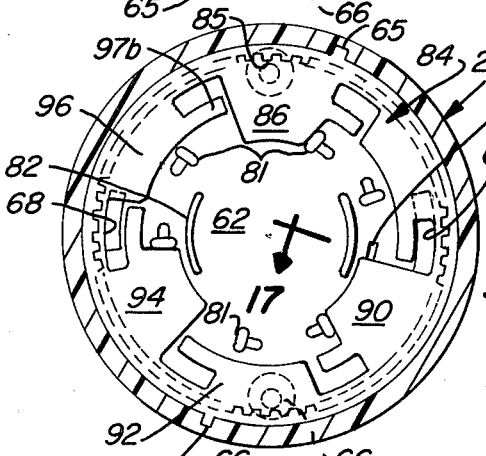
Fig.-5b
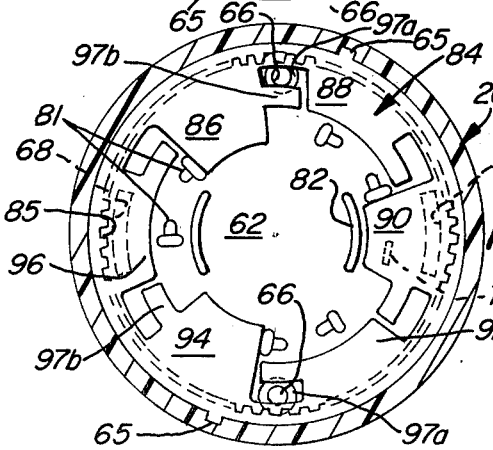
Fig.-5c

PULSATING SPRAY APPARATUS

The present invention relates to pulsating spray apparatus. More particularly, it pertains to improvements in such apparatus.

U.S. Pat. No. 3,762,648, issued Oct. 2, 1973, and assigned to the same assignee as the present application, discloses a spray nozzle having certain unique features. U.S. Pat. No. 3,801,019, issued Apr. 2, 1974, to the same assignee is directed to improvements on such subject matter. U.S. Pat. No. 3,958,756 issued May 25, 1976, extends the overall disclosure to a number of other improvements.

As a result of the development, design and manufacturing implementation of the subject matter of the aforementioned patents, apparatus has been produced and sold to, and well received by, the purchasing public. The numbers of such units enjoyably received by members of that public now number into many millions. Nonetheless, the assignee of the aforementioned applications has continued to stress further development in order even better to improve the product. This application is intended to be a disclosure of such further improvements.

In terms of a development in what might be called an overall field of producing a pulsed output of water flow, and specifically as adapted to use in an individual's shower, the aforementioned patents describe apparatus for producing a pulsating flow of water. While the prior art had disclosed means for producing a pulsating flow, the techniques suggested apparently were insufficiently subject to implementation as to create a viable market. Only applicants' assignee was able to establish that kind of market. The purchasing public has benefited tremendously from the introduction into the marketplace of applicants' products as covered by the foregoing patents.

As the prosecution in the Patent Office of the foregoing patents established, and as also has been established in litigation concerning the same, pulsation of a water spray was not, in itself, new. However, the unique directions of approaches taken in connection with the aforementioned patents have now been upheld as representing at least what one might call patentable improvement.

The apparatus of the aforementioned patents employs what might be technically described as a forced-vortex turbine. While this may not be strictly true in terms of the earliest of such patents, it certainly has been a major part of the success in the last two of those patents. The forced-vortex turbine approach was so successful as to have been subsequently copied and, thereafter, protected.

Despite the tremendous success of that which is already in the marketplace and which is represented by the aforementioned patents, applicants' assignee has continued to seek enhanced implementation of the forced-vortex approach. That effort has succeeded, as will be herein described.

Accordingly, it is a general object of the present invention to provide pulsating spray apparatus which improves upon that heretofore known.

Another object of the present invention is to provide such apparatus in which the pulsating fluid rate may be better controlled.

A further object of the present invention is to provide pulsating spray apparatus in which effective result, as perceived by the user, may be achieved while yet utilizing a decreased flow of water.

Still another object of the present invention is to provide apparatus of the foregoing character which incorporates structure to attain water-usage conservation while yet achieving that degree of commercial success which characterized the units initially identified to the public.

The improvements exhibited herein are somewhat varied in nature. One involves relating first and second fluid flow paths to an orifice that extends through the outer periphery of a cavity that contains a fluid-flow pulsator. That additional fluid flow is used to control overall fluid transmittal through the unit. Another feature relates to the employment of a free-floating turbine within the device and the cooperation therewith of surfaces so spaced and defined as to reduce total energy usage. Still another unique approach, described in detail hereinafter as to specific embodiment, involves a special valving arrangement, or regulator, which insures that, regardless of variation of incoming pressure, a condition is enforced such that outlet flow does not exceed a selected quantity regardless of input fluid pressure.

The features of the present invention which are believed to be novel are set forth with particularity in the appended claims. The organization and manner of operation of the invention, together with further objects and advantages thereof, may best be understood by reference to the following description taken in connection with the accompanying drawings, in the several figures of which like reference numerals identify like elements, and in which;

Figure 4:
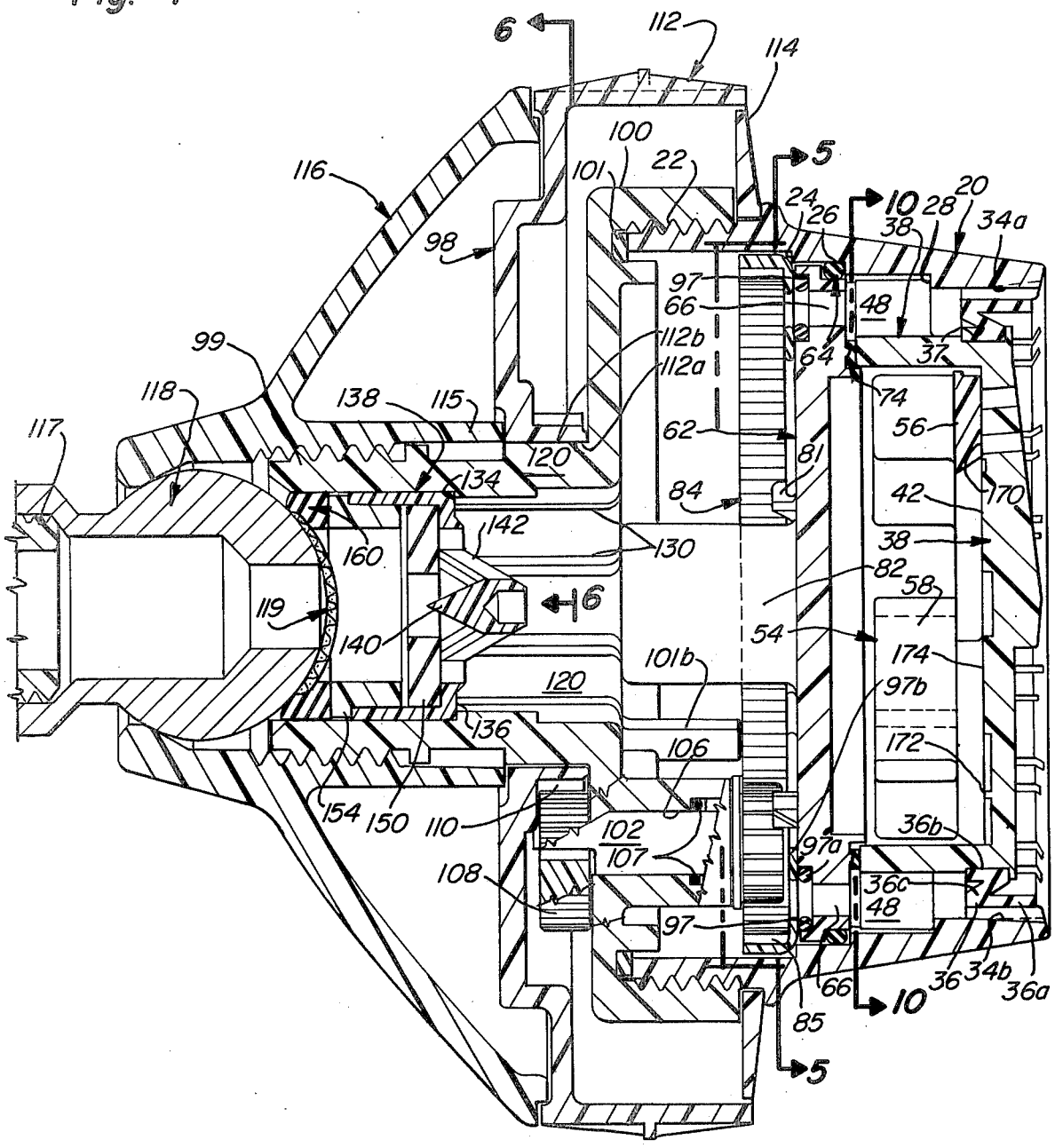
FIG. 4 is a cross-sectional view taken along the line 4—4 in FIG. 2.

FIG. 5*a* is a cross-sectional view taken along the line 5—5 in FIG. 4 and depicting shutter valve operation at one position in its range of movement;

FIG. 5*b* is a view similar to FIG. 5*a* but showing the shutter valve operation at one end limit of movement;

FIG. 5*c* is a view similar to those of FIGS. 5*a* and 5*b* but showing the shutter valve at an opposite limit of movement from that shown in FIG. 5*b;*

Figure 7:
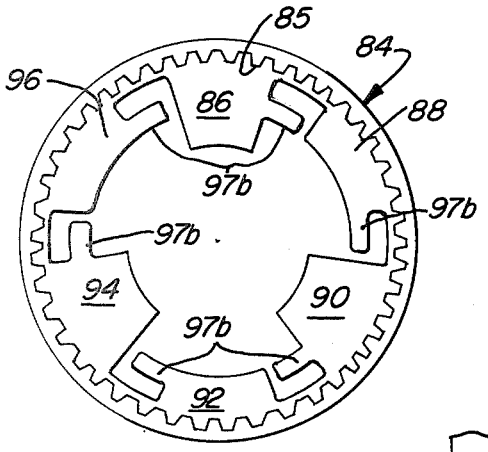

FIG. 6 is a partial cross-sectional view taken along the line 6—6 in FIG. 4;

FIG. 7 is a plan view of a shutter plate depicted particularly in FIGS. 3 and 4 and the application of which is explained in connection with FIGS. 5*a*–5*c;*

Figure 3:
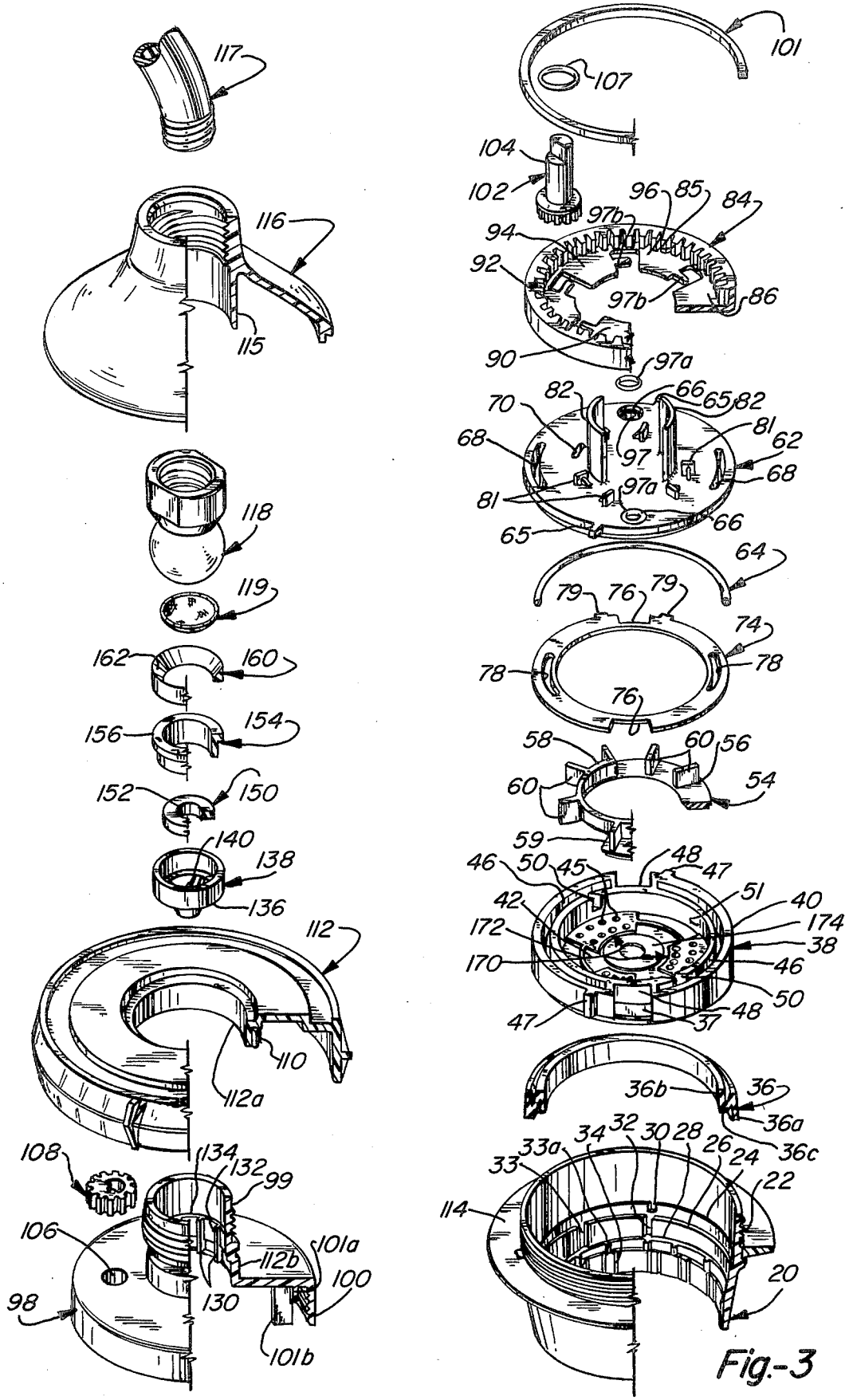
FIG. 3 is an exploded perspective view of components included within the apparatus as shown in FIGS. 1 and 2.
Figure 8:
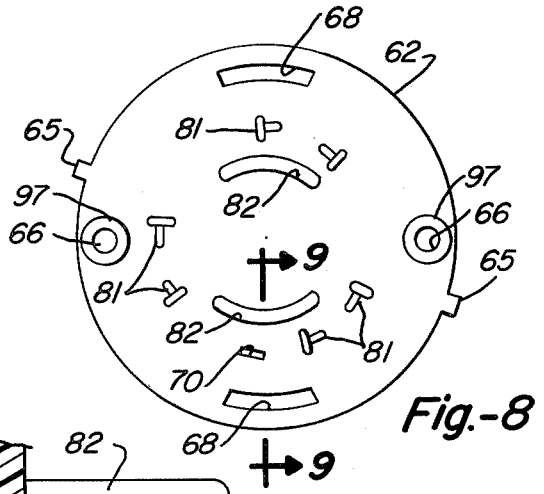
Figure 9:
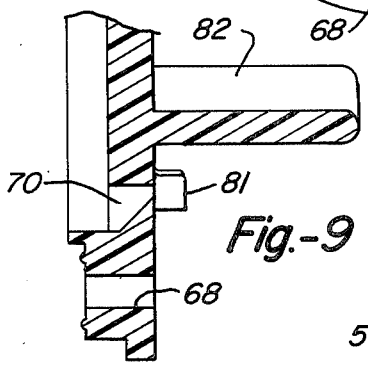
Figure 10:
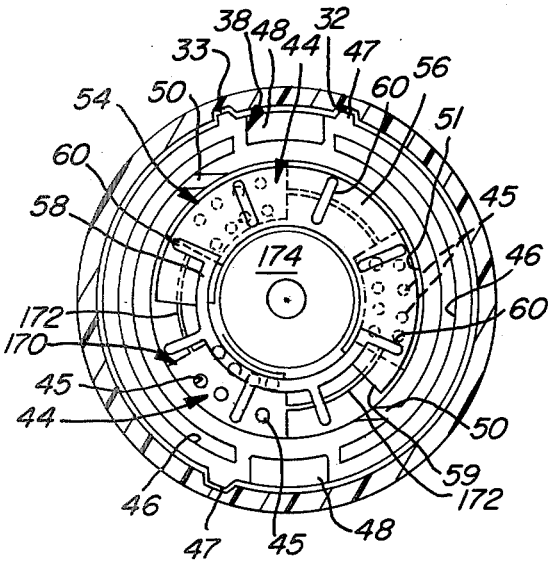

FIG. 8 is a plan view of a flow-directing plate shown in FIGS. 3 and 4;

FIG. 9 is a cross-sectional view taken along the line 9—9 in FIG. 8;

FIG. 10 is a cross-sectional view taken along the line 10—10 in FIG. 4.

Figure 2:
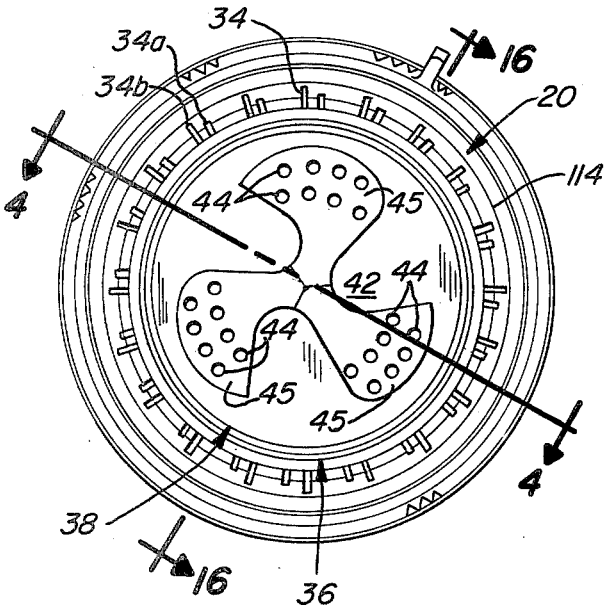
FIG. 2 is a front view of the showerhead.
Figure 11:
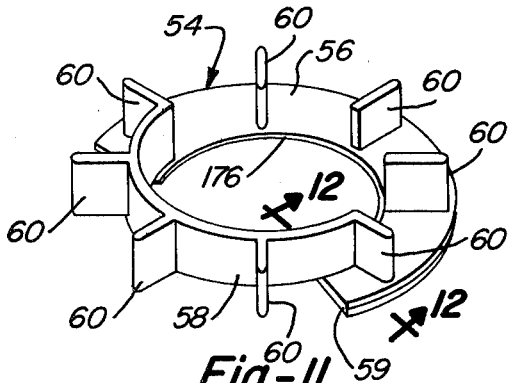
Figure 12:
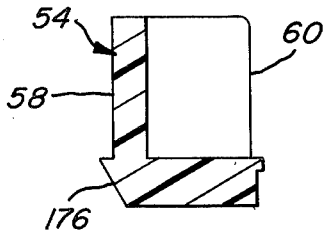
Figure 13:
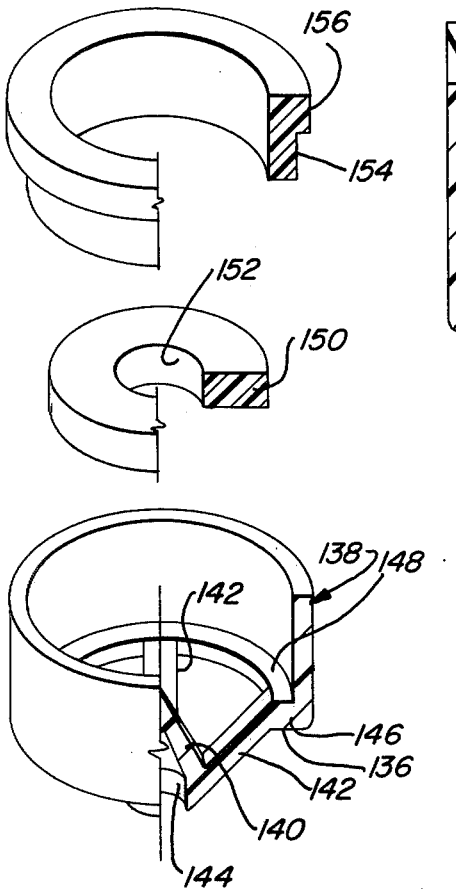
Figure 14:
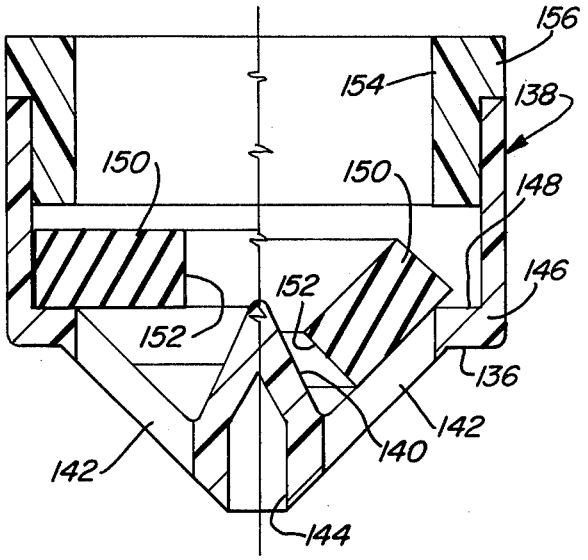
Figure 15:
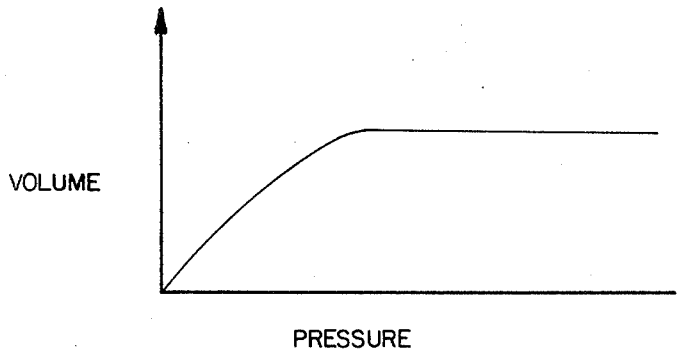
Figure 17:
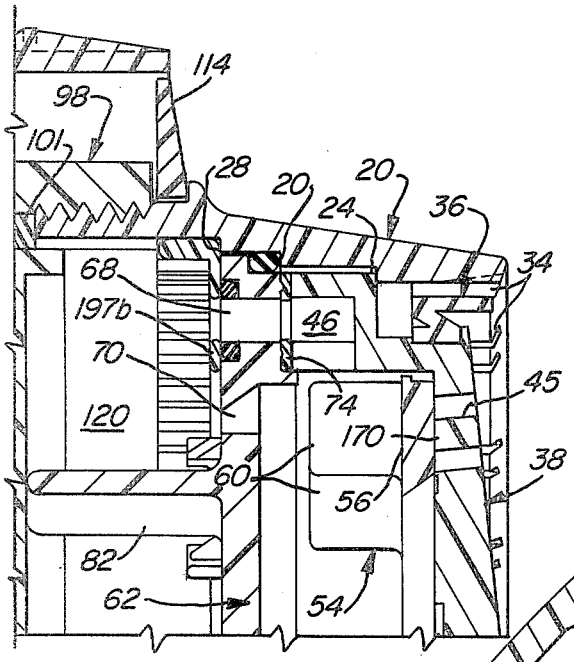
Figure 16:
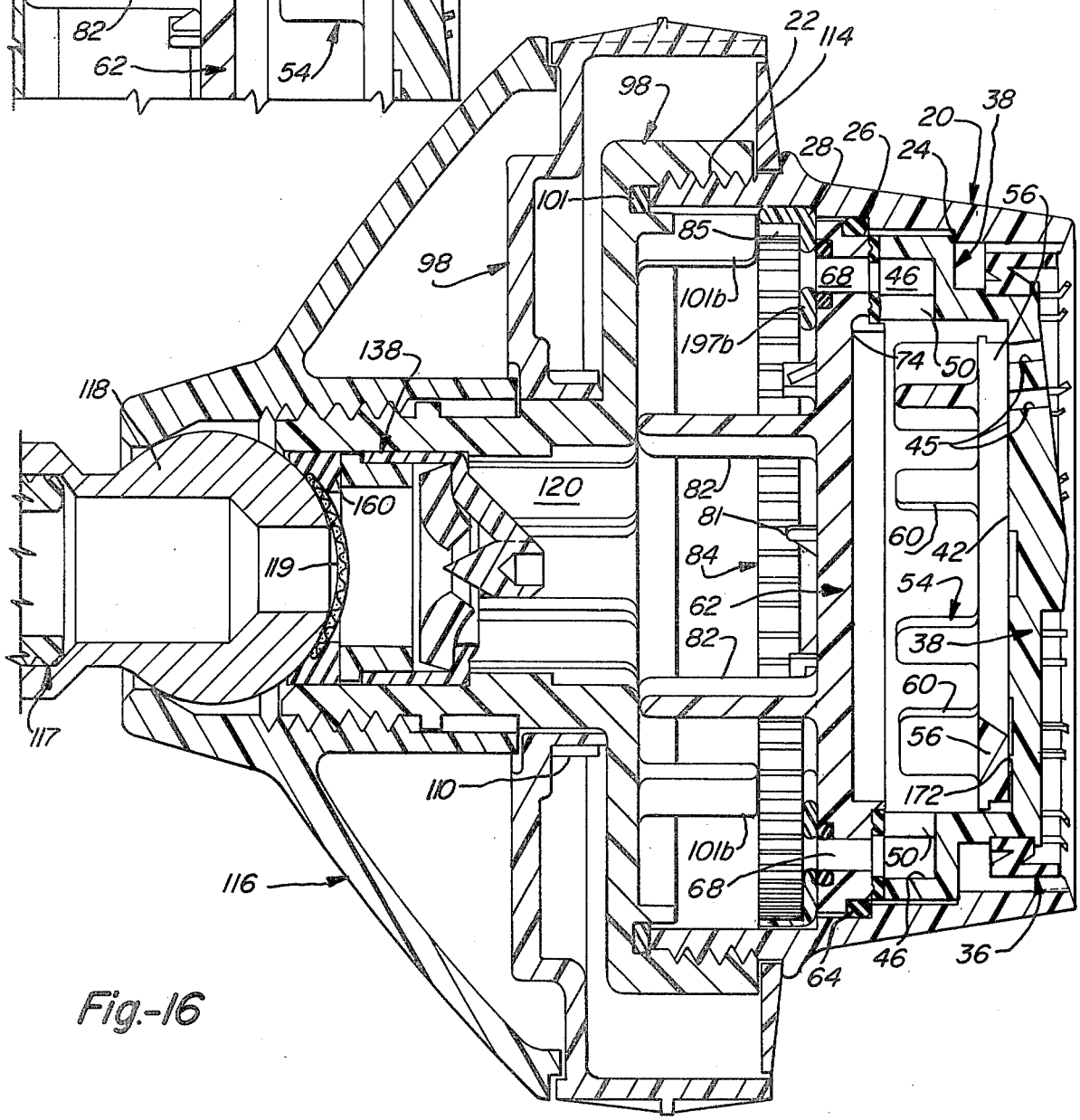

FIG. 11 is a perspective view of a turbine included within the apparatus of FIGS. 1–4;

FIG. 12 is a fragmentary cross-sectional view taken along the line 12—12 in FIG. 11;

FIG. 13 is an exploded and enlarged perspective view of components shown in FIGS. 3 and 4;

FIG. 14 is a cross-sectional view of FIG. 13 as assembled but with the left half showing one condition and the right half showing a different condition;

FIG. 15 is a graph illustrating operation of the apparatus particularly delineated in FIGS. 13 and 14;

FIG. 16 is a full section taken along the line 16—16 in FIG. 2;

FIG. 17 is a partial section taken as along the line 17—17 in FIG. 5*b;*

Figure 19:
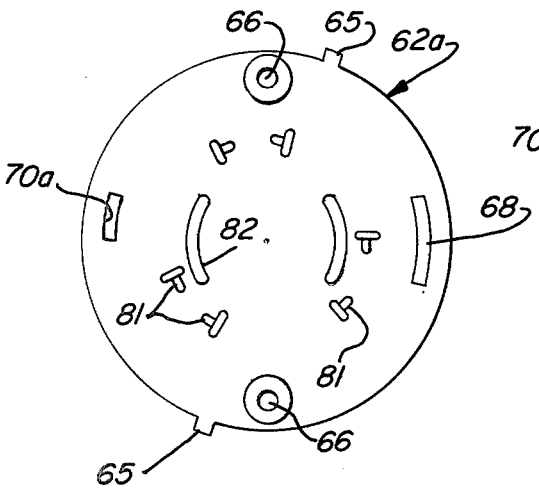
Figure 20:
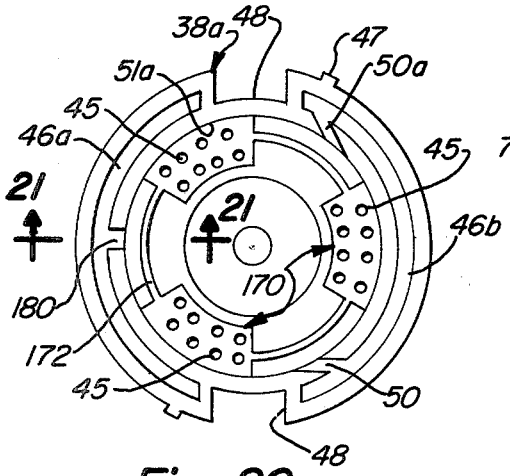
Figure 21:
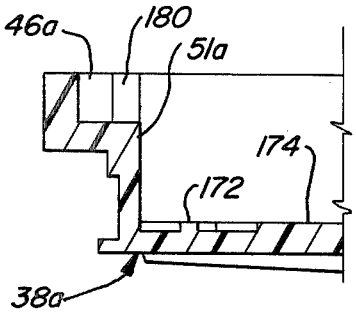

FIG. 18 is an exploded perspective view of a portion of an alternative embodiment;

FIG. 19 is a plan view of a flow directing plate shown in FIG. 18;

FIG. 20 is a plan view of a spray cup shown in FIG. 20;

FIG. 21 is a partial section view taken along the line 21—21 in FIG. 20; and

Figure 22C:
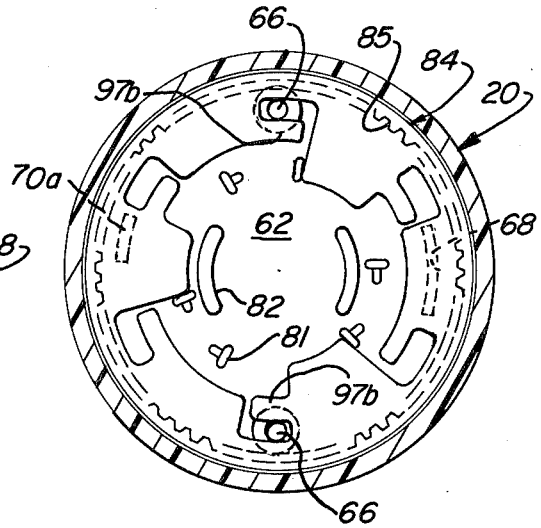
Figure 22B:
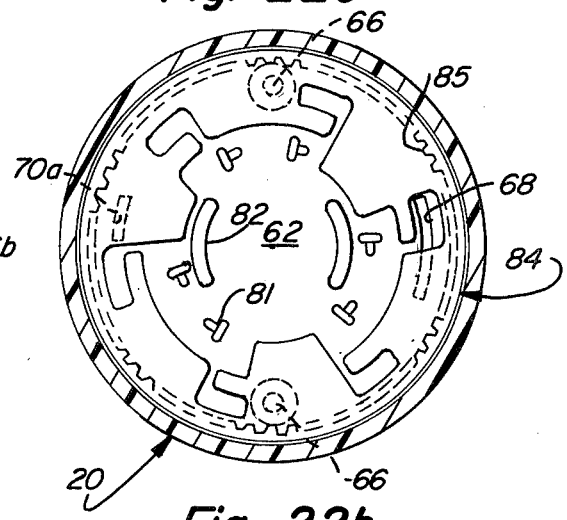
Figure 22A:
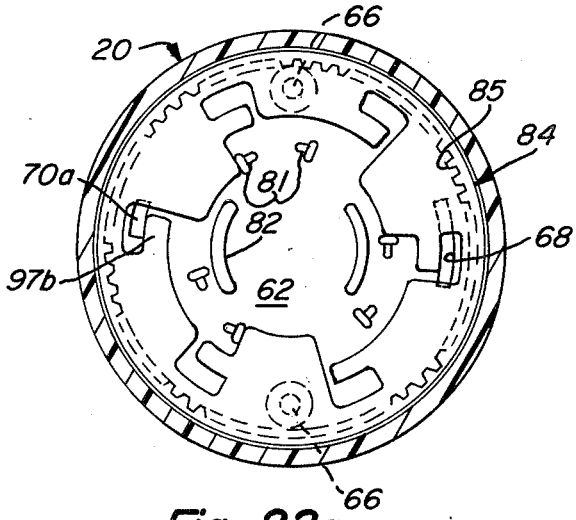

FIGS. 22*a*–22*c* are views analogous to FIGS. 5*a*–5*c* but illustrating operation of the alternative embodiment of FIG. 18.

Figure 1:
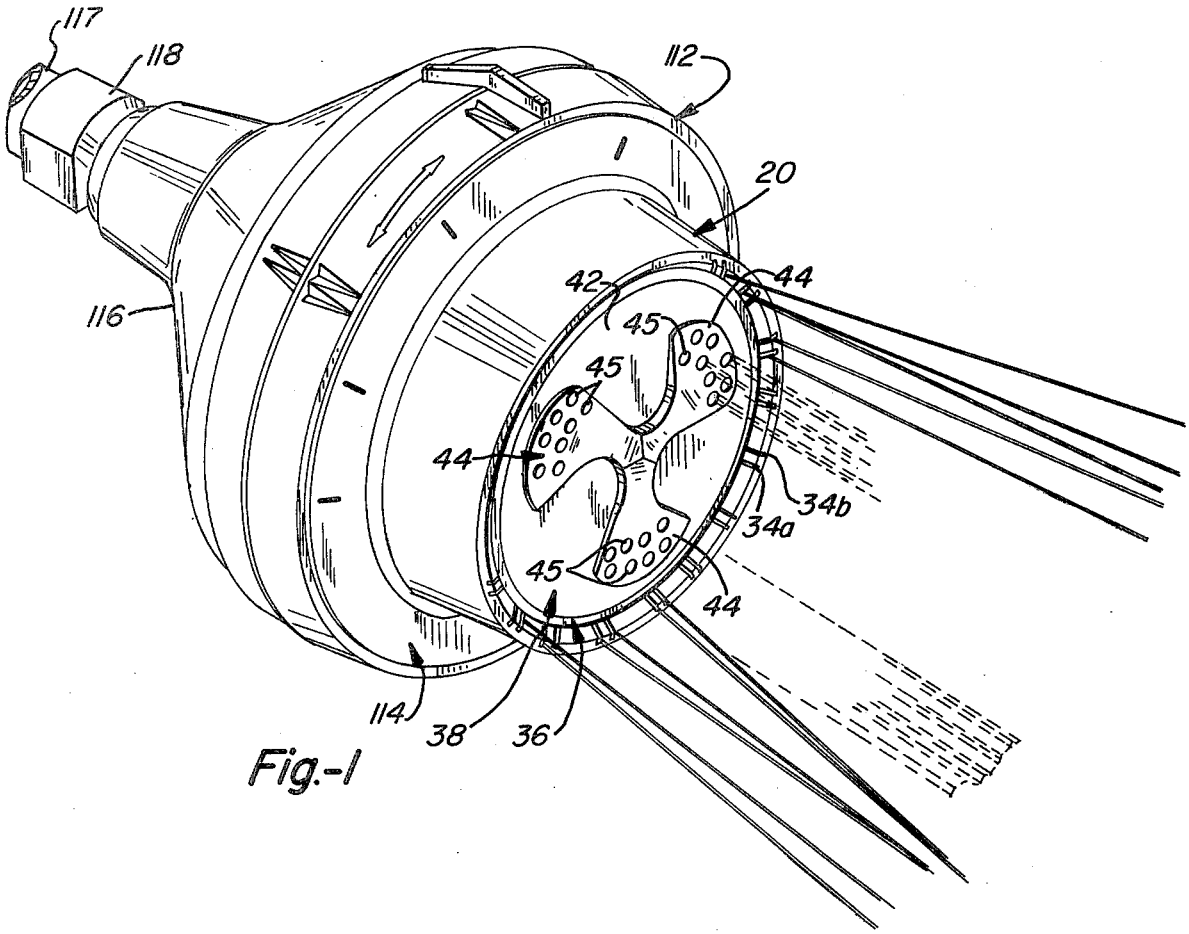
FIG. 1 is a perspective view of a completed showerhead incorporating the features of the present invention.

FIG. 1 depicts a showerhead constructed for connection to and mounting upon a stationary supply pipe as conventionally emerging through the wall near the top of a shower stall. By comparison with the aforesaid U.S. Pat. No. 3,801,019, it will be observed that essentially the same structure may be arranged for attachment to the end of a flexible pipe so as to be capable of being held in the hand of the user. Either form of usage and adaptation is contemplated for the embodiments specifically described herein.

In a principal embodiment, the showerhead includes a lower housing 20 of hollow cylindrical configuration formed to present an externally threaded neck 22 at its upper end. The internal central passage through lower housing 20 is formed to define three radial shoulders 24, 26 and 28 which provide seats for axially locating other elements of the showerhead to be described. A pair of sets of diametrically opposed longitudinal slots 30 and 32 extend downwardly respectively from shoulders 24 and 26 to orient rotatively such other elements. Another slot 33, extending downwardly from shoulder 26 serves further to orient one of those elements. A circumferentially-spaced series of nubs 33*a*, projecting radially inward just beneath shoulder 28, serve to facilitate proper seating with respect to slots 34 of a seal 36. Slots 34 extend longitudinally from a position below shoulder 28 and define fluid spray outlet channels at the lower end of lower housing 20. Moreover, slots 34 are disposed in circumferentially and successfully spaced pairs of slots 34*a* and 34*b* individually of respective different inclinations relative to the overall longitudinal axis of the showerhead unit. Seal 36 is seated to extend across the open radially-inward sides of slots 34 in order to complete definition of those slots as one group of spray discharge outlets. At its radially-inward side, seal 36 is seated within an annular groove 37 formed on the exterior of a spray cup 38 that has a tubular main body 40 and an end wall or orifice plate 42 closing the bore of body 40.

Seal 36 is formed of a resilient material such as rubber. It has an integral N-shaped cross section, in the longitudinal direction of the unit, composed of a pair of longitudinal legs 36*a* and 36*b* spaced apart by a connecting web 36*c*. Leg 36*b* is of a length at least approximately the same as the width, in the longitudinal direction of the unit, of groove 37. When the unit is assembled, seal 36 is seated between slots 34 and groove 37 with leg 36*b* disposed in groove 37 and leg 36*a* extending across the open radially inner sides of slots 34 so as, together with those slots, to define a group of orifices or outlets distributed around the lower end of housing 20. As shown, the outer sides of those orifices are inclined with respect to the longitudinal axis of the unit so that within each pair a slot 34*a* defines an angle of two degrees and a slot 34*b* defines an angle of five degrees. The result is the emergence of two different spray patterns in the form of cones having respective different divergence angles. In a preferred unit, there are twenty pairs of slots 34. Additional particularization as to the desired detailed construction of seal 36 is set forth in aforementioned U.S. Pat. No. 3,958,756, and that application is incorporated herein by reference. Alternatives for seal 36 are described in that prior patent.

Formed through end wall 42 are three like groups 44 of discharge orifices 45 that lie in a symmetrical relationship within an annular band concentric with the central axis of the unit. Formed into the upperwardly-facing end portion of body 40 are a pair of similar flow-carrying troughs 46 each of which extends partially around the circumference of member 40 with the two being in symmetrically-disposed relationship. The adjacent ends of troughs 46 terminate short of each other so as to allow for the definition of a diametrically-opposed pair of longitudinally extending flow passages 48. Formed into the inner wall of each of troughs 46 is a tangentially-directed passage 50 that permits water under pressure within the respective trough to be discharged into the interior cavity 51 centrally defined within body 40. Body 40 is so formed as to define, below troughs 40, a peripheral margin that seats upon lowermost shoulder 28 and which, together with laterally projecting lugs 47 receivable within slots 32, serves to locate body 40, and thus spray cup 38, within lower housing 20. When spray cup 38 is seated within lower housing 20, seal 36 is radially compressed so that, as already described, its leg 36*a* is disposed over slots 34 so as to define one group of orifices, while orifices 45 in end wall 42 define a second group of spray discharge orifices.

A rotary valve member 54 rests upon the inner or upper side of end wall 42 and is retained by the inner wall of body 40 for rotation about the central axis of the unit. Valve member 54 is a one-piece molded element preferably of a glass-reinforced nylon material. Member 54 includes a flat, generally C-shaped base plate portion 56 which lies in a radially central plane and extends for approximately 225° about its central axis. A semi-cylindrical portion 58 is integrally joined to the opposite ends of portion 56 and extends circumferentially around the remaining 135° of member 54. The lower margin of semi-cylindrical portion 58 is coplanar with the top or upper flat surface of portion 56, so that the latter has its lower surface 59 spaced downwardly from the lower margin of portion 58. A plurality of radially extending blades 60 are integrally mounted upon and circumferentially spaced about portions 56 and 58 in symmetrically-spaced relationship to the central axis of the unit.

Underlying surface 59 of portion 56 rests upon the inner surface of end wall 42 and is so located as to overlie, at all times and rotative positions, at least a portion of orifices 45. The annular band within which orifices 45 lie corresponds in general to the annular band transversed by portion 56 upon rotation of valve rotor 54. Blades 60 are so located as to be impinged upon by water discharged through tangential passages 50. Valve rotor 54 thus is driven in rotation at a rate which varies with the rate of flow of water through tangential passages 50 of the spray cup assembly.

A flow-directing plate 62 overlies the upper end of spray cup 38 and is employed to direct and control the flow of water to the various discharge orifices. An O-ring 64 seals the lower perimeter of plate 62 atop shoulder 26, diametrically-opposed nubs 65 laterally projecting from plate 62 seating within slots 30. Diametrically disposed near the lateral margins of plate 62 are a pair of circular openings 66 and a second pair of segmentally-shaped openings 68. Also included is another segmental opening 70. Nubs 47 orient plate 62 relative to spray cup 38, so that openings 66 are longitudinally aligned with and communicate directly with flow passages 48 in spray cup 38. In the same way, openings 68 in plate 62 are aligned and communicate with troughs 46 of spray cup 38, while opening 70 is located radially inwardly of the inner wall of spray cup 38. A gasket 74 is disposed between the lower side of plate 62 and the upper end of spray cup 38. Gasket 74 has notches 76 and openings 78 respectively aligned with openings 66 and 68 in plate 62. Spaced to either side of one of notches 76 are outwardly projecting lugs 79 that seat gasket 74 respectively in slots 32 and 33 of lower housing 20.

The underside of plate 62 is formed to define respective portions of passages 66, 68 and 70 so as to cooperate with the coordinating passage portions defined in spray cup 38 as well as with notches 76 and openings 78 in gasket 74. That is, the generally tubular body portion of the housing which contains valve member 54 and tangential passages 50 is characterized by mating walls through which the different flow paths or passages wholly or partially extend. On the wall defined by the bottom side of plate 62 is a projecting rib that is pressed into seating engagement with gasket 74 so as to extend continuously around the general perimeter of the underside of plate 62 and is so disposed relative to openings 68 and 66 as to serve as a seal director. Further details in this respect may be had by reference to the aforesaid U.S. Pat. No. 3,958,756 which is incorporated by reference herein.

Integrally projecting from the upper surface of plate 62 are stop ribs 81, spaced apart in pairs, and a pair of upwardly projecting compression tabs 82. Slidably supported for rotation upon the upper surface of plate 62 is an annular shutter plate 84 which has an internal ring gear 85 and six inwardly-projecting symmetrically-disposed segmentally-shaped shutter blades 86, 88, 90, 92, 94 and 96, those blades projecting inwardly from the lower margin of ring gear 85.

As perhaps best seen in FIGS. 5*a*–5*c*, the radially-inward extent of shutter blades 86, 90 and 94 exceeds that of blades 88, 92 and 96, so that alternate blades are of relatively short or long inward-radial extension. The internal radial extension of blades 88, 92 and 96 is such that the inner ends of those blades fall radially outward beyond the circle defined by stops 81, while blades 86, 90 and 94 project radially across that circle or location. Thus, when shutter plate 84 rests on top of flow directing plate 62, rotary movement of the shutter plate is limited to one end limit defined by the engagement of one of blades 86, 90 and 94 with a corresponding one end of stops 81 and an opposite end limit is defined by the engagement of an adjacent blade 86, 90 and 94 with a corresponding opposite stop. It will be observed that the different sets of stops each project from plate 62 to very substantially through plate 84 in the direction of the inlet end of the unit. Moreover, the stops are individually spaced radially inward from the alternate ones of the blades so as to be in the path of corresponding intervening ones of the blades.

Directing attention again to each of passages 66 in plate 62, a counterbore 97 extends a short distance into each of passages 66 from the inlet side of plate 62. Seated within each of counterbores 97 is an O-ring 97*a* which serves as a resilient annular seal element. Considering the peripheral portions of plate 84 that join the different ones of the shutter blades as being divided portions of the base of the blades themselves, it will be observed that at least one blade always serves at least partially to captivate a corresponding one of O-rings 97*a*. To extend the degree of such captivation of the corresponding O-rings 97*a*, web members 97*b*, spaced inwardly from the periphery of plate 84, project at least substantially across the respective spaces between successive ones of the shutter blades. Web members 97*b* are in a position that maintains captivation of O-rings 97*a* even when shutter plate 84 is so moved as to remove the corresponding ones of the blade from a covering relationship to openings 66. To that end, each of web members 97*b* projects integrally from one side of one of the shutter blades and extends into close-spaced relationship with the successive one of the blades.

The individual parts described thus far are held in their assembled position by an upper housing 98 that has a centrally-disposed upstanding tube 99 and a downwardly depending skirt 100. Skirt 100 is internally threaded so as to receive the external threads on the upper end of lower housing 20 as at 22. A resilient washer 101, seated within a circumferential rib 101*a*, completes a seal between the upper and lower housings.

Rotation of shutter plate 84 is accomplished by a pinion gear 102 meshed with ring gear 85 and having its shaft 104 rotatively received within a bore 106 in upper housing 98. An O-ring 107 (FIG. 3) seals shaft 104 to bore 106. A second gear 108, rotatively locked to shaft 104 exteriorly of upper housing 98, is meshed with a gear 110 integrally formed on a control ring 112 rotatively supported by an integrally-formed journal 112*a* which rides upon a bearing 112*b* defined on tube 99.

As indicated, washer 101 is seated within a recess defined by a downwardly depending and inwardly spaced rib 101*a*. Circumferentially-spaced and also downwardly-projecting struts 101*b* project downwardly slightly below the lower margin of skirt 100 so as, together with tabs 82, to insure a tight seal of all matable elements in order to avoid leakage through the joints between the different connecting parts. During assembly, an annular ring 114 is trapped between the lower end of upper housing 98 and a shoulder on lower housing 20. Ring 114 is primarily for cosmetic purposes. It provides a stationary member upon which a scale, for indicating the rotative position of control ring 112 relative to the housing, may be located.

An upper cone 116 is threaded upon the upper end of tube 99. Cone 116 frictionally clamps a swivel ball fitting 118, atop a screen 119, so as to mount the assembly upon a supply pipe 117. Cone 116 has a forward margin 115 which also serves as a stop against rearward movement of control ring 112.

The foregoing description could be understood with reference only to FIGS. 1–5, although FIGS. 6–12 might also be useful. It should be noted that there has been a failure to make reference to certain components shown in these figures and that there are some differences in those figures thus far discussed as compared with the prior patents which have been incorporated herein by reference. Before getting to such new material, however, it is believed to be desirable to more fully describe the operation of the apparatus as thus far described, even though that description will be somewhat redundant in the light of prior U.S. Pat. Nos. 3,801,019 and 3,762,648 which have been incorporated herein by reference.

The overall approach of the particular embodiment herein primarily illustrated is that of delivering three general types of sprays. The first is an all-continuous spray in which all water discharged from the showerhead is delivered as a continuous and uninterrupted stream or series of streams. The second is an all-pulsating spray in which all water delivered from the showerhead is discharged in pulsating or cyclically interrupted streams, or a combination of continuous-pulsating spray in which a portion of the water is discharged in continuous streams while the remaining portion is discharged as a pulsating or interrupted spray. The showerhead, when discharging a combination spray, may be adjusted to vary selectively the proportioning of relative amounts of continuous spray to pulsating spray. This adjustment is made in a manner such that the frequency of pulsation of the pulsating spray component is increased as the proportion of the pulsating spray to continuous spray is changed. When the device is operated to produce an allpulsating spray, the frequency of pulsation of the spray may be selectively varied.

In use, water from the stationary supply pipe 117 enters the showerhead through ball fitting 118. Addressing for the moment shutter plate 84, it will be seen that the inlet chamber is provided with two sets of outlets constituted of openings 66, 68 and also with outlet 70 through flow directing plate 62. Those openings respectively constitute the inlet ends of three separate and distinct flow passages through the showerhead. With reference to FIG. 16, a first flow passage, starting from ball fitting 118 and an inlet chamber 120, extends from opening 68 to the interior through 46 of spray cup 38 and thence through tangential passages 50 into the interior of spray cup 38 so as to communicate with discharge orifices 45. Water following this first flow passage impinges on blades 60 of rotary valve member 54 as the water is discharged from tangential passages 50. Thus, the water following this flow passage drives valve rotor 54 in rotation so as cyclically to interrupt the streams of water discharged from orifices 45 as portion 56 on valve 54 rotates through overlying relationship with the individual ones of orifices 45.

Referring now to FIG. 17, a second flow passage extends from inlet chamber 120 through opening 70 in plate 62 and passes from opening 70 directly into the interior of spray cup 38 for discharge through orifices 45. Because water flowing through this second flow passage 70 is discharged axially to the interior of spray cup 38, water following the second flow passage 70 does not contribute to the rotary speed of valve rotor 54 and, in fact, exerts a slight braking action on rotor 54 as rotating blades 60 are struck by the axially directed stream from opening 70. The water following the first and second passages is divided at plate 62 and recombines within the interior of spray cup 38 prior to discharge through orifices 45. Consequently, all water flowing through those first and second flow passages is discharged from orifices 45 as a pulsating spray.

With reference to FIG. 4, a third flow passage extends from inlet chamber 120 through openings 66 in plate 62. Openings 66 are aligned with passages 48 on the exterior of spray cup 38, passages 48 communicating directly with the second group of orifices 34. Because the third flow passage is at the exterior of spray cup 38, water flowing through the third flow passage bypasses valve rotor 54 and is discharged in a continuous stream from orifices 34.

Control of the frequency of pulsation of the spray and the apportioning of the relative amounts of pulsating to non-pulsating spray is accomplished by rotatively positioning shutter plate 84 so as fully or partially to block openings 66, 68 and 70 in accordance with the position of the various shutter blades relative to the openings. Referring again to FIGS. **5*a*–5*c*, shutter plate 84 is shown at three basic positions of rotative adjustment relative to flow directing plate 62. In FIG. 5*a*, shutter plate 84 is midway between its opposite end limits of rotative adjustment relative to plate 62, while FIGS. 5*b* and 5*c* show shutter plate 84 respectively at its opposite end limits of rotative adjustment as determined by the engagement of shutter blade 94 with the corresponding end of a stop rib 81 as in FIG. 5*b* or the similar engagement of shutter blade 90 with the opposite stop rib 81 as shown in FIG. 5*c***. The other longer blades similarly cooperate the respective sets of stop ribs.

In FIG. **5*a*, shutter plate 84 is so positioned that openings 66 are completely covered by shutter blades 86 and 92, opening 70 is completely covered by shutter blade 94, while one-half of each of openings 68 is covered by blades 94 and 88. With shutter plate 84 in this rotative position, the only openings in flow directing plate 62 which are exposed are openings 68. Hence, all flow through the showerhead occurs through the first flow passage referred to above—namely, from openings 68 to troughs 46 and then via tangential passages 50 into the interior of spray cup 38 for discharge through orifices 45. As already indicated, water passing through passages 50 impinges on blades 60 or creates a forced vortex to drive valve 54 in rotation and thus cyclically open and close orifices 45. Because all of the water flowing through the unit, when shutter plate 84 is in the position of FIG. 5*a*, must be discharged through orifices 45, all of the spray discharged is in pulsating form. Further because of the fact that all of the water then flowing through the showerhead impinges on or otherwise moves blades 60, valve 54** is then driven at a maximum rate of rotation for a given amount of supply pressure, and the frequency of the pulsation of the delivered streams is at a maximum.

Rotation of shutter plate 84 is accomplished by annular rotation of control ring 112, gear 110 on control ring 112 driving pinion 108 so as to rotate shaft 104 and pinion 102. Pinion 102 is in mesh with ring gear 85 of shutter plate 84. Upon rotation of shutter plate 84 in a clockwise direction from the position shown in FIG. **5*a* toward the position shown in FIG. 5*b*, the area of openings 68 exposed between shutter blades 88, 90, 94 and 96 remains constant. However, as shutter plate 84 rotates clockwise away from its FIG. 5*a* position, the trailing edge of shutter blade 94 begins to expose opening 70 and an increasing portion of the water flowing through the device passes through opening 70**.

Water passing through opening 70 follows the second flow passage described above and is discharged from opening 70 axially into the interior of spray cup 38. The radial location of opening 70 is such that water flowing from that opening passes axially through the rotary path of blades 60, thus exerting a slight braking action on the rate of rotation on the blades. The rate of rotation of the blades is further reduced due to the fact that, as the volume of flow through opening 70 begins to build up when that opening is exposed by rotation of shutter plate 84, a consequent reduction occurs in the volume of flow through openings 68, troughs 46 and tangential passages 50. This reduces the volume and rate of flow of water discharged through passages 50 from which the driving force causing the rotation of valve rotor 54 is derived.

Because openings 66 remain blocked during movement of shutter plate 84 between the FIGS. 5*a* and 5*b* positions, all flow through the unit occurs within the first and second flow passages described above, these flows being united in the interior of spray cup 38 and thus being discharged through orifices 45. Therefore, an all-pulsating flow is achieved throughout the full range of movement of shutter plate 84 between the FIG. 5*a* and FIG. 5*b* positions. However, the frequency of pulsation of this flow varies in accordance with the rotative position of shutter plate 84, the frequency being a minimum when the maximum area of exposure of opening 70 is achieved in the FIG. 5*b* position and the frequency of pulsation increasing as shutter plate 84 is rotated from the FIG. 5*b* position toward the FIG. 5*a* position at which the pulsation frequency reaches a maximum for a given supply pressure.

Upon movement of shutter plate 84 in a counterclockwise direction from the FIG. 5*a* position toward the FIG. 5*c* position, opening 70 remains covered by shutter blade 94, while the counterclockwise movement of shutter blades 86 and 92 begins progressively to expose openings 66 to flow from chamber 120. Furthermore, counterclockwise movement of shutter blades 88 and 94 from the FIG. 5*a* position toward the FIG. 5*c* position progressively reduces the area of openings 68 available to flow from inlet chamber 120 until, upon arrival of shutter plate 84 at the FIG. 5*c* position, openings 68 are completely covered by shutter blades 88 and 94, while shutter blades 86 and 92 have moved to positions whereby openings 66 are fully open.

When shutter plate 84 is in the FIG. 5*c* position, all flow through the unit occurs by way of the third flow passage previously mentioned. That flow passes from openings 66 through passageways 48 along the exterior of spray cup 38 so as to be discharged from the outer ring of orifices 34. Because the flow to orifices 34 completely bypasses rotary valve 54, all water discharged from orifices 34 is delivered in the conventional continuous stream. Thus, when shutter plate 84 is in the FIG. 5*c* position, an all-continuous spray is discharged by the device.

When shutter plate 84 is at some position intermediate the FIG. 5*a* and 5*c* positions, both openings 68 and openings 66 are partially opened so that flow through the device is apportioned between those two sets of openings in accordance with the rotative position of shutter plate 84. At these intermediate positions, the spray discharge consists of a continuous spray component constituted by that portion of the flow which passes through openings 66 and a pulsating spray portion constituted by the remaining portion of the flow which passes through openings 68. Over this range of movement of shutter plate 84, the frequency of pulsation of the pulsating portion of the spray will likewise vary in proportion to that component of the flow which passes through orifices 45. Starting from an all-continuous flow with shutter plate 84 in the FIG. 5*c* position, rotation of shutter plate 84 toward the FIG. 5*a* position produces a gradually increasing component of pulsating flow that has a progressively increasing frequency as the FIG. 5*a* position is approached.

To summarize the flow characteristics of the unit, starting with shutter plate 84 at the FIG. 5*c* position and assuming a constant supply pressure within inlet chamber 120, all flow emitted from the unit is discharged from orifices 34 in continuous uninterrupted or non-pulsating streams. As the control ring is rotated to drive the shutter plate in a clockwise direction away from the FIG. 5*c* position, the percentage of the flow discharged from orifices 34 is progressively reduced, while a correspondingly increasing percentage of the flow is discharged from orifices 45. Spray discharged from orifices 45 is a pulsating spray and, as the percentage of flow through orifices 45 builds up, the frequency of pulsation increases until shutter plate 84 reaches the FIG. 5*a* position at which time the percentage of spray discharged from orifices 34 has been decreased to zero. Continued rotation of control ring 112 to drive shutter plate 84 in a clockwise direction beyond the FIG. 5*a* position causes the device to discharge an all-pulsating spray but decreases the frequency of the pulsation as shutter plate 84 moves toward the FIG. 5*b* position. The frequency of pulsation may also be varied by varying the supply pressure through adjustment of any control faucets which may be included in the supply system.

It will be observed that the operational description just set forth is very much the same as that in the aforementioned and cross-referenced U.S. Pat. No. 3,958,756. This is because the basic mode of operation is the same insofar as the user experiences the benefit of the pulsating or other combinations of spray patterns. Attention will now be directed to the specific features of improvement which are the subject of the present application.

Spaced circumferentially around and projecting inwardly from the lower portion of the interior of tube 99 are a plurality of inwardly-projecting longitudinally-oriented ribs 130 circumferentially joined around their upper extent by an intergal annular band 132 which has a radial thickness of about half the radial projection of ribs 130. The upper end surface of band 132 together with the upper end surfaces of ribs 130 together define a shoulder 134. Seated on shoulder 134 is the lower shoulder 136 projecting radially inward from the bottom of a cylinder 138 the external wall of which is slidingly receivable within the internal wall of the upper portion of tube 99. Coaxially disposed at the lower end of cylinder 138 is an upright cone 140 suspended from the inner margin of shoulder 136 by a plurality of successively-spaced radially-oriented and downwardly-depending struts 142. Opening from the bottom within cone 140 is a chamber 144.

The upper surface of a web 146 which forms downwardly-facing shoulder 136 defines an upwardly-facing shoulder 148. An annular washer 150 is slidably received within the internal wall of cylinder 138 so that its bottom peripheral margin rests upon shoulder 148 with its central opening 152 coaxially encircling the apex end portion of cone 140. Washer 150 is of a flexible and resilient material, so that it normally rests in a horizontal position as shown in the left half of FIG. 14, while it is capable of being deformed downwardly by pressure upon its upper surface such that its lower surface is urged toward struts 142 and its opening 152 is caused to move downwardly around the body of cone 140 as shown in the right half of FIG. 14. As it is so moved downwardly, the water flow passageway is progressively restricted.

A collar 154 is slidably received within the upper end of cylinder 138, so as loosely to captivate washer 150 in the illustrated and described position. An outwardly projecting flange 156 on collar 154 seats the collar atop cylinder 138. Seated within the uppermost end portion of tube 99 on top of collar 154 is a resilient seal 160 which defines an upwardly-facing bevelled seat 162 against which screen 119 is pressed by ball 118 when the entire unit is assembled as shown in FIG. 4.

Washer 150 and cone 140 cooperate to define a regulator which limits the rate of water flow through the fluid channel defined by tube 99 substantially to a predetermined maximum upon increase of water pressure beyond a selected level. This is illustrated in FIG. 15 wherein the abscissa represents incoming pressure and the ordinate defines volume of flow. As shown, the volume of water flow steadily increases as the pressure is increased up to a selected point at which further increase in pressure does not result in any significant further increase in rate of water flow or volume. Preferably, the components are selected and designed so that, at an input water pressure of thirty p.s.i. on the fast pulse setting, the showerhead utilizes approximately 1.8 gallons of water per minute. That compares with a usage of 5.8 gallons of water per minute by a typical standard showerhead. By contrast with such a standard showerhead, a saving of about 20 gallons of water per five-minute shower may be effected. Translated to typical usage by a family of four taking an average of three showers per day, the saving could be as much as 22,000 gallons per year. Of course, there will be additional savings in energy usage to heat hot water.

It will be observed that cone 140 and washer 150 cooperate in the manner of a somewhat basic needle valve, although in this case it is the orifice defined by opening 152, rather than the needle defined by cone 140, which moves. Orifice or opening 152 moves by the deflection of the material of washer 150 that defines that orifice. The deflection of washer 150 may be expressed in mathematical terms to enable calculation of the amount of flow for a given pressure, and non-linear programming techniques may be used to permit the achievement of an optimum design for a variety of different constraints which may be imposed as desired. However, an empirical approach, involving only a small amount of "cut-and-try" with extrapolation, will be satisfactory for present purposes. In any case, the spacing from washer 150 and the apex angle of cone 140 relative to the diameter, thickness and flexibility of opening 152 are selected to achieve the desired flow limiting.

An ultimate goal in pulsating showerheads is the attainment of a desirable perception of the water pulses upon arrival at the skin of the user. For a given input pressure and rate of water flow, this can be attained only by the giving of proper attention to outlet orifice numbers and sizes with relation to pulse frequencies. In the illustrated embodiment, of course, the water flow is caused to pulsate as a result of rotation of rotary valve member 54. Member 54 is a turbine the blades 60 of which are driven by streams emitted from passages or nozzles 50. More accurately, however, the water inletted through passages 50 create a forced vortex that causes valve member 54 to seek to rotate along with that vortex of water.

At the same time, a static pressure is maintained within cavity 51 at a level dependent upon the relationship between the net or average outlet area and the net inlet area for water flow. In general, both the perception of pulses by the user and even the operability of the unit are very much a function of water flow.

In view of the foregoing, the introduction of the regulator, composed essentially of washer 150 and cone 140, places stringent requirements upon the showerhead mechanism if proper operation is to be maintained. In particular, the limitation upon water flow rate imposed by the regulator means that a more narrow variation in volume is present. In accommodation, several differences are incorporated into the herein embodied unit as compared, for example, with the otherwise similar showerhead of the aforesaid U.S. Pat. No. 3,958,756.

As one improvement, the number of outlet orifices 45 in each group 44 is reduced in number from nine to eight individual orifices with the one eliminated being at one end of the group so as to decrease the circumferential span of the orifices in each group. A result of this change is to provide a longer "off" cycle and a shorter "on" cycle.

Instead of the total of six tangential passages or nozzles successfully used in the embodiment detailed in U.S. Pat. No. 3,958,756, the present embodiment employs a total of only two such passages or nozzles 50, one assigned with regard to each of respective troughs 46. The vortex driving in-flow area and the now somewhat reduced out-flow area defined by orifices 45, together with the change in pulse timing resulting both from an increase in the angle of shoe 56 and with the decrease in the extent of each of the groups of orifices, all combine to increase the pulse output force and thereby increase the pulse perception by the user.

The increase in vortex cavity static pressure achieved by incorporation of the aforedescribed improvements is not, however, entirely advantageous. That is, the increased static pressure within cavity 51 tends to increase the drag between undersurface 59 of shoe 56 and end wall 42. As a result, rotary valve member 54 may tend to stall during lower flow rates occasioned by the limitations imposed by the regulation of cone 140 and washer 150.

To the end of avoiding such stalling, each group of outlet orifices 45 is located in an annularly segmental pad 170 slightly upstanding from the basic interior wall surface of end wall 42. Moreover, a circumferential rib 172, spaced inwardly from the periphery of end wall 42, upstands the same amount as and connects each adjacent pair of pads 170. Thus, undersurface 59 of shoe 56 rides evenly over the interiorly-facing surface of pads 170 and ribs 172, while the total surface contact between undersurface 59 and the contacting surfaces carried by end wall 42 is minimized.

Centrally located on the upper surface of end wall 42 is a cylindrical boss 174 which upstands an amount the same as that of pads 170 and ribs 172 and the perimeter of which is spaced slightly inwardly from the innermost margins of pads 170. Correspondingly, the inner marginal wall of shoe 56 is downwardly and inwardly tapered as indicated at 176 in FIG. 12. Boss 174 tends to hold rotary valve member 54 in centered relation within cavity 51.

All of these improvements result in increased pulse force output for a given quantity of water flow or an equal or similar force output as compared with earlier versions but with a reduction in water flow. Rotary valve member 54 establishes a predetermined cycle of pulsation with desired flow and non-flow intervals, the flow capacity of the outlet is of a correspondingly predetermined amount, the cavity is dimensioned to exhibit a static pressure under normal fluid flow which enables rotation of the turbine, and the selection of the flow versus non-flow intervals is such as to enhance the static flow pressure within the cavity. The flow capacities of the inlet and outlet passages or orifices are selected in order to create substantially a maximum of the output force of pulses coordinate with selection of the flow capacities so as to achieve substantially a maximum in the velocity of pulses of fluid from the outlet orifices.

FIG. 18 illustrates an alternative in the achievement of output pulse frequency control. Only those portions of the showerhead necessary to an understanding of this alternative are shown in FIG. 18, it being understood that the other components necessary for a complete and operative assembly, as shown in FIGS. 1–4, also are included and the general manner of selection as between spray and pulsating modes is the same as previously discussed with regard to FIGS. 5a–5c. The device of this alternative includes a lower housing 20, seal 36, spray cup 38a, rotary valve member 54, gasket 74, flow director plate 62a and shutter plate 84. Components changed in the alternative of FIG. 18, as compared with the similar components of the preceding figures, have been denoted by adding a lower-case letter to the corresponding number. Thus, only spray cup 38a and flow director 62a need have changes.

In more particular, flow director 62a is changed by eliminating opening 70 somewhat centrally located in the earlier version and restricting the segmental extent of one of openings 68 of the earlier version so as to become a speed control port 70a. Control port 70a is aligned with opening 178 in gasket 74 so as to allow water to enter trough 46a in spray cup 38a. There is no tangential passage 50 leading into chamber 51a from trough 46a. Instead, a single radially extending passage 180 leads from trough 46a into cavity 51a. The other trough 46b has a first tangential passage 50 as before and includes an additional and second tangential passage 50a near the other end of its segmental extent.

The result of the foregoing is that all water diverted to create the force vortex within cavity 51a, and thus cause the driving of valve member 54, is controlled by shutter plate 84 to enter slot 68 in flow divertor 62a and be discharged into cavity 51a through passages 50 and 50a. On the other hand, water diverted by shutter plate 84 into opening 70a is introduced into the outer edge of the forced vortex created within chamber 51a, and it is the water which enters through passage 180 that controls the speed or rotation of the turbine and the resulting rate of pulsation of the emitted streams.

The addition of water through orifice 180 reduces the vortex effect otherwise created by drive passages 50 and 50a. At the same time, the water static pressure within chamber 51a is reduced. With only the addition of extra flow by way of orifice 180, the pulse force output is increased, while the speed of pulsation is reduced. As shown by the different positions illustrated in FIGS. 22a–22c, the amount of water diverted through driving slot 68 may be throttled down at the same time as the speed reduction port 70a is further opened.

Somewhat analogous to the discussion of FIGS. 5a–5c, the condition shown in FIG. 22a is one in which port 70a is almost fully exposed so that a near maximum of pulse speed reduction is activated as water is emitted, via openings 68 and 70a from the pulse discharge outlets 45. FIG. 22b, however, illustrates the condition in which all discharge still is from pulse outlets 45 but in which port 70a is closed so that there is no speed reduction. Like FIG. 5c, FIG. 22c represents the relationship for an only all-continuous outlet from orifices 34a and 34b by way of flow through openings 66.

This permits maintaining a constant flow and further aiding in the achievement of speed reduction while yet not changing the pulse force output. One advantage for the mode of speed control illustrated in this alternative is that of achieving a more linear adjustment of pulsation rate. In addition, the introduction of the additional speed control water flow into the peripheral margin of the forced vortex reduces the tendency of valve member 54 to stall at low water flows. Moreover, wider variation of speed may be obtained in the lower range of possible speed of pulsation.

Several different improvements have been shown for a combination of a continuous spray and pulsating-discharge showerhead as compared with earlier versions constructed in the overall along the same general principles. A significant increase in economy of water usage is attained. At the same time, pulse perception by the user is maintained and even enhanced, while problems attendant primarily to lower maximum flow rate are overcome. Also disclosed is an alternative approach to pulsation speed control. While that alternative approach is described and depicted herein by means of separate views pertaining to a second embodiment, it is to be understood that those improvements may be incorporated into the first embodiment of this application as well as into the embodiments of the earlier patents which have been incorporated by reference.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. In a pulsating spray apparatus that includes:

a housing having a fluid inlet and a fluid discharge outlet;

means in said housing defining a flow path from said inlet to said outlet;

pulsating means in said flow path for cyclically interrupting the flow of fluid from said inlet to said outlet and causing a pulsating spray to be discharged therefrom, said pulsating means including a forced vortex driven turbine rotatable within a cavity defined with said housing;

control means for adjusting the fluid flow from said inlet to said outlet;

nozzle means for tangentially imparting driving force to said vortex and creating a predetermined static fluid pressure within said cavity;

means defining a first fluid flow passage from said control means to said nozzle means with said control means including means for regulating the fluid flow through said first fluid flow passage to said nozzle means;

the improvement comprising:

means defining an orifice leading laterally inward toward the outer edge margin of the forced vortex created by flow through said nozzle means and action of said turbine;

means defining a second fluid flow passage from said control means to said orifice;

said control means further including means for selectively regulating fluid flow through said second fluid flow passage to said orifice;

and said orifice being oriented relative to said turbine to deliver its fluid flow in a direction which reduces the effect of said forced vortex in driving said turbine.

2. Apparatus as defined in claim 1 in which said first and second passages and said orifice are assigned mutually interrelated flow capacities to effect reduction in the speed of said vortex created by flow through said nozzle means and a reduction in static pressure within said cavity in response to said flow through said second passage.

3. Apparatus as defined in claim 1 in which said second passage introduces additional flow of said fluid into said cavity and in which said cavity is of finite size to create additional fluid pulse force output from said cavity in response to said additional flow.

4. Apparatus as defined in claim 3 in which the rate of said pulsation is reduced upon increase of flow in said second passage.

5. Apparatus as defined in claim 1 in which said control means inversely throttles flow of said fluid as between said first and second passages.

6. Apparatus as defined in claim 5 in which said control means maintains a constant flow from said outlet.

7. Apparatus as defined in claim 5 in which adjustment of said control means maintains the force of pulses emitted from said outlet upon reduction of the rate of said pulsation.

8. In a pulsating spray apparatus that includes:

a housing having a fluid inlet and a fluid discharge outlet;

means in said housing defining a flow path from said inlet to said outlet;

pulsating means in said flow path for cyclically interrupting the flow of fluid from said inlet to said outlet and causing a pulsating spray to be discharged therefrom;

and said pulsating means including a cavity within which is disposed a turbine, in which a forced vortex of fluid is created by flow from said inlet to drive said turbine, and in which a shoe on said turbine serves as a valve to pulsate flow through said outlet;

the improvement comprising:

an outlet wall of said housing having said outlet in the form of circumferentially-spaced openings valvingly opened upon movement of said shoe with rotation of said turbine, said shoe being urged toward said wall by force of the flowing fluid, and the input end of said openings each being defined in a pad interiorly upstanding from said outlet wall with said pads individually being circumferentially spaced in correspondence with movement of said shoe.

9. Apparatus as defined in claim 8 in which said pads are each joined in pairs by a similarly upstanding circumferential rib disposed to maintain even rotation of said turbine as said shoe rides over said pads and the ribs.

10. Apparatus as defined in claim 8 in which said pads together define an interiorly-facing circumferential seat, and in which said shoe is shaped on its internal margin to define a surface slidable in rotation upon said seat.

11. Apparatus as defined in claim 8 in which a cylindrical boss projects inwardly from said outlet wall, and in which said turbine includes a surface which rides upon the exterior of said boss as said turbine rotates.

12. Apparatus as defined in claim 8 which further comprises:

means defining a plurality of groups of orifices with each group individually constituting a respective one of said circumferentially-spaced openings, said orifices in each group being circumferentially distributed substantially throughout the circumferential span of the corresponding one of said pads;

said valve establishing with said groups of orifices in said pads a predetermined cycle of pulsation with selected flow and non-flow intervals, the flow capacity of said outlet being of predetermined amount, and said cavity being dimensioned to exhibit a static fluid pressure under normal fluid flow enabling rotation of said turbine;

and the circumferential extent of said shoe being selected relative to the circumferential span of each of said groups of said orifices in said pads to determine the length of said flow interval relative to the length of said non-flow interval in establishment of a maximum output force of fluid pulses emitted from said orifices for the minimum amount of said fluid flow necessary to maintain said rotation of said turbine.

13. Apparatus as defined in claim 12 in which the flow capacities of said inlet and said outlet are selected to create substantially a maximum of the output force of pulses from said outlet coordinate with selection of said flow capacities to achieve substantially a maximum in the velocity of pulses of fluid from said outlet.

14. In a showerhead having a housing, a coupling on said housing for attachment to a supply of water, an outlet in said housing for discharging a spray of water received through said coupling, a valve disposed within said housing for controlling the flow of water through said coupling and in discharge from said outlet, and a fluid channel defined in said housing upstream from said valve for conveying water received through said coupling and discharged from said outlet under control of said valve, the improvement comprising;

regulator means, disposed in said fluid channel, for limiting the rate of water flow through said fluid channel substantially to a predetermined maximum upon increase of incoming water pressure beyond a selected level;

said regulator means including an orifice the fluid flow area of which changes in response to incoming fluid-flow pressure relative to back-pressure produced beyond said orifice and by which fluid flow is restricted in response to increased such pressure up to a predetermined limit at which fluid flow is limited against further increase in said pressure;

said regulator means further including an annular washer peripherally coupled to the inner wall of said fluid channel, said washer having a central opening and being of a resilient material permitting flexure of its radially central portion axially of itself upon the pressure thereagainst of fluid flowing in said channel across which said washer is positioned, and a cone centrally disposed axially within said channel with its apex facing said opening on the downstream side thereof, the spacing from said washer and apex angle of said cone relative to the diameter, thickness and flexibility of said opening defining said orifice and being selected to effect said limiting;

and said fluid channel further including a conduit having an interiorly defined annular seat, a collar engaged against said seat, and an integral circumferentially spaced plurality of struts supporting said cone from said collar.

15. Apparatus as defined in claim 14 in which said washer is seated within said collar, and in which a bushing is received within said collar for confining said washer therewithin with said bushing including an outwardly projecting flange seated upon the upstream end of said collar.

16. Apparatus as defined in claim 15 which further includes a resilient ring received within said conduit and seated atop said bushing, said ring having an upstream lateral surface defining a tapered seat effectively receptive of and matable with a spherical ball having an axial opening for the flow of said fluid.

* * * * *